US005895341A

United States Patent [19]

Jones

[11] Patent Number: 5,895,341

[45] Date of Patent: Apr. 20, 1999

[54] JUMP ROPE SIMULATOR

[76] Inventor: Charles W. Jones, 413 Park Ter. #4 P.O. Box 228, Prince Frederick, Md. 20678

[21] Appl. No.: 09/095,977

[22] Filed: Jun. 11, 1998

[51] Int. Cl.[6] ..... A63B 5/22

[52] U.S. Cl. ..... 482/81; 482/82

[58] Field of Search ..... 482/81–82

[56] References Cited

U.S. PATENT DOCUMENTS

| | | | |
|---|---|---|---|
| 1,189,307 | 7/1916 | Stokes et al. | 482/82 |
| 1,505,473 | 8/1924 | Klubnick | 482/81 |
| 3,419,269 | 12/1968 | Saffer | 482/81 |
| 4,109,906 | 8/1978 | Wilson | 482/82 |
| 4,637,606 | 1/1987 | Hunn | 482/82 |
| 4,693,464 | 9/1987 | Cedar | 482/81 |

OTHER PUBLICATIONS

Better Buy, Jump for Joy, Lite Line Jump Rope 482/82 Mar. 1984.

*Primary Examiner*—Jerome Donnelly

[57] ABSTRACT

A jump rope simulator for providing an exercise workout simulating the jumping of a jump rope. The simulator includes a pair of hand-held units. Each unit includes a handle and a flexible cord. The handle has opposite first and second ends. One of the ends of the flexible cord is coupled to the first end of the handle such that the flexible cord may be twirled about a twirling axis extending from the handle.

10 Claims, 3 Drawing Sheets

10
11
12
2
3

12

15
29
30
13
26
31
14
21
20
22
18
5
17
5
19

28
15

4
11
27
6
6
13
31
14
21
20
22
18
17
19

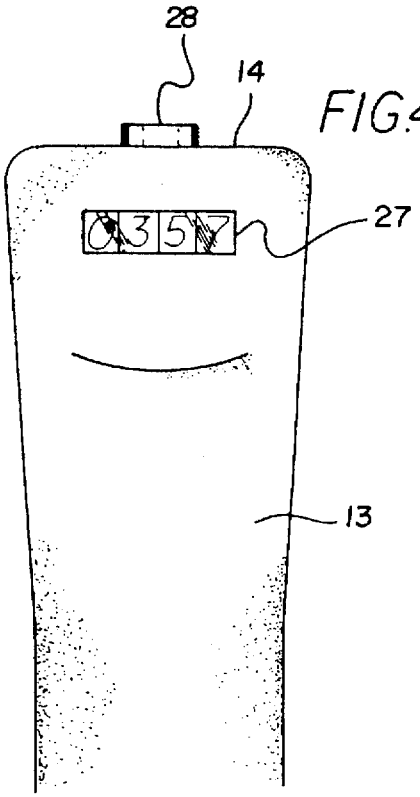
FIG.4
FIG.6
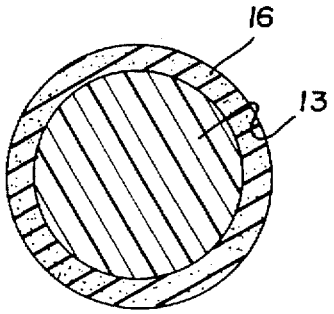
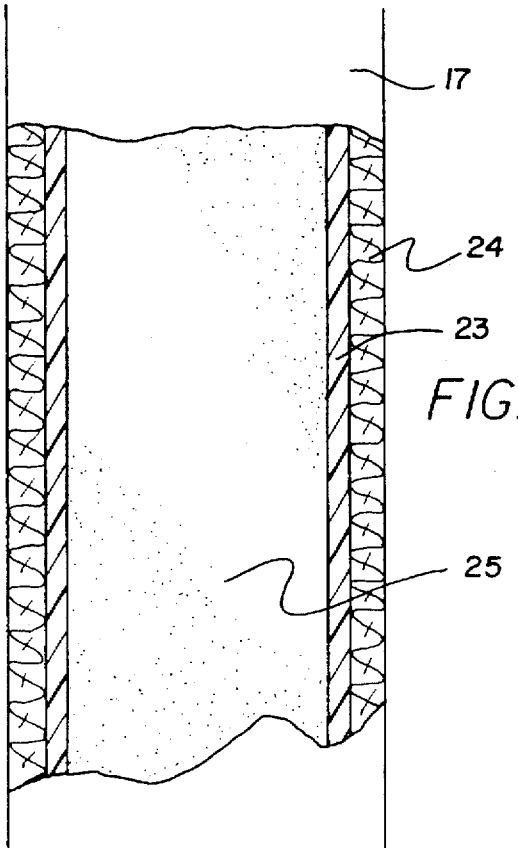
FIG.5

JUMP ROPE SIMULATOR

BACKGROUND OF THE INVENTION

1. Field of the Invention

The present invention relates to jump rope simulators and more particularly pertains to a new jump rope simulator for providing an exercise workout simulating the jumping of a jump rope.

2. Description of the Prior Art

The use of jump rope simulators is known in the prior art. More specifically, jump rope simulators heretofore devised and utilized are known to consist basically of familiar, expected and obvious structural configurations, notwithstanding the myriad of designs encompassed by the crowded prior art which have been developed for the fulfillment of countless objectives and requirements.

Known prior art jump rope simulators include U.S. Pat. No. 3,212,777; U.S. Pat. No. 4,593,899; U.S. Pat. No. 4,179,119; U.S. Pat. No. 4,101,123; U.S. Pat. No. 5,643,149; and U.S. Pat. No. Des. 352,236.

While these devices fulfill their respective, particular objectives and requirements, the aforementioned patents do not disclose a new jump rope simulator. The inventive device includes a pair of hand-held units. Each unit includes a handle and a flexible cord. The handle has opposite first and second ends. One of the ends of the flexible cord is coupled to the first end of the handle such that the flexible cord may be twirled about a twirling axis extending from the handle.

In these respects, the jump rope simulator according to the present invention substantially departs from the conventional concepts and designs of the prior art, and in so doing provides an apparatus primarily developed for the purpose of providing an exercise workout simulating the jumping of a jump rope.

SUMMARY OF THE INVENTION

In view of the foregoing disadvantages inherent in the known types of jump rope simulators now present in the prior art, the present invention provides a new jump rope simulator construction wherein the same can be utilized for providing an exercise workout simulating the jumping of a jump rope.

The general purpose of the present invention, which will be described subsequently in greater detail, is to provide a new jump rope simulator apparatus and method which has many of the advantages of the jump rope simulators mentioned heretofore and many novel features that result in a new jump rope simulator which is not anticipated, rendered obvious, suggested, or even implied by any of the prior art jump rope simulators, either alone or in any combination thereof.

To attain this, the present invention generally comprises a pair of hand-held units. Each unit includes a handle and a flexible cord. The handle has opposite first and second ends. One of the ends of the flexible cord is coupled to the first end of the handle such that the flexible cord may be twirled about a twirling axis extending from the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jump rope simulator apparatus and method which has many of the advantages of the jump rope simulators mentioned heretofore and many novel features that result in a new jump rope simulator which is not anticipated, rendered obvious, suggested, or even implied by any of the prior art jump rope simulators, either alone or in any combination thereof.

It is another object of the present invention to provide a new jump rope simulator which may be easily and efficiently manufactured and marketed.

It is a further object of the present invention to provide a new jump rope simulator which is of a durable and reliable construction.

An even further object of the present invention is to provide a new jump rope simulator which is susceptible of a low cost of manufacture with regard to both materials and labor, and which accordingly is then susceptible of low prices of sale to the consuming public, thereby making such jump rope simulator economically available to the buying public.

Still yet another object of the present invention is to provide a new jump rope simulator which provides in the apparatuses and methods of the prior art some of the advantages thereof, while simultaneously overcoming some of the disadvantages normally associated therewith.

Still another object of the present invention is to provide a new jump rope simulator for providing an exercise workout simulating the jumping of a jump rope.

Yet another object of the present invention is to provide a new jump rope simulator which includes a pair of hand-held units. Each unit includes a handle and a flexible cord. The handle has opposite first and second ends. One of the ends of the flexible cord is coupled to the first end of the handle such that the flexible cord may be twirled about a twirling axis extending from the handle.

Still yet another object of the present invention is to provide a new jump rope simulator that allows a user to simulate jumping rope in confined spaces and areas with low head room in which a traditional jump rope would be impractical.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic partial side view of the handle of a unit of the present invention taken from the circle 4 on FIG. 3.

FIG. 5 is a schematic sectional view of an embodiment of the flexible cord of a unit of the present invention taken from line 5—5 on FIG. 2.

FIG. 6 is a schematic cross sectional view of a handle of a unit of the present invention.

DESCRIPTION OF THE PREFERRED EMBODIMENT

Figure 1:
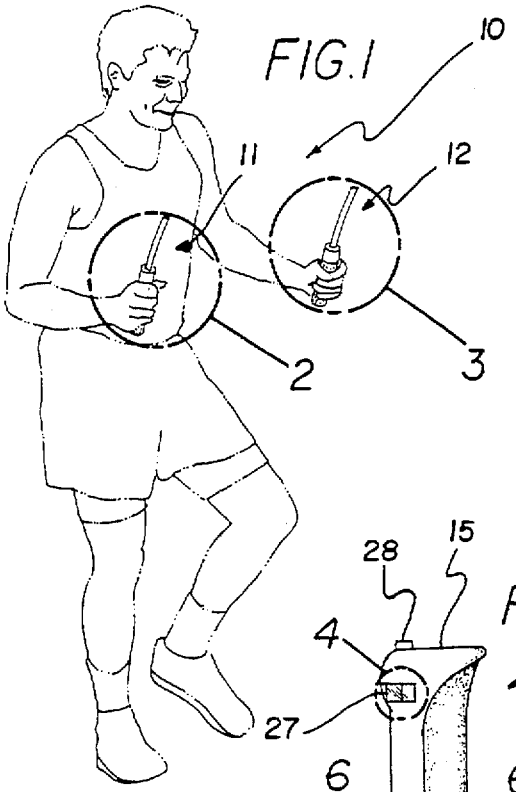
FIG. 1 is a schematic view of a new jump rope simulator in use according to the present invention.
Figure 2:
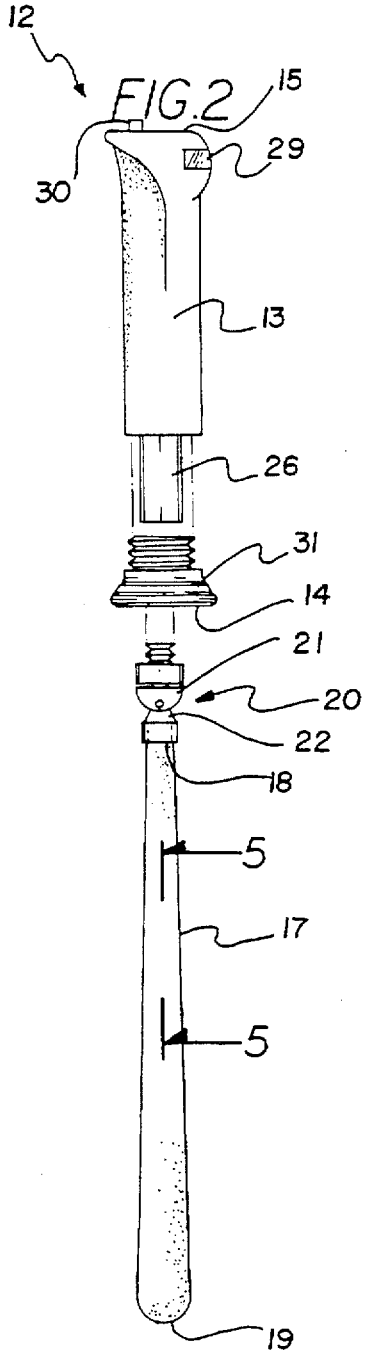
FIG. 2 is a schematic exploded side view of a unit of the present invention.
Figure 3:
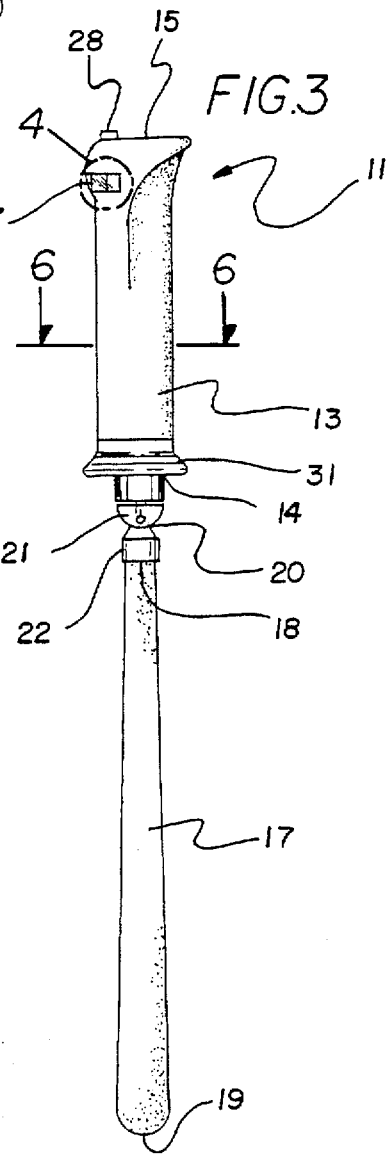
FIG. 3 is a schematic side view of another unit of the present invention.
Figure 7:
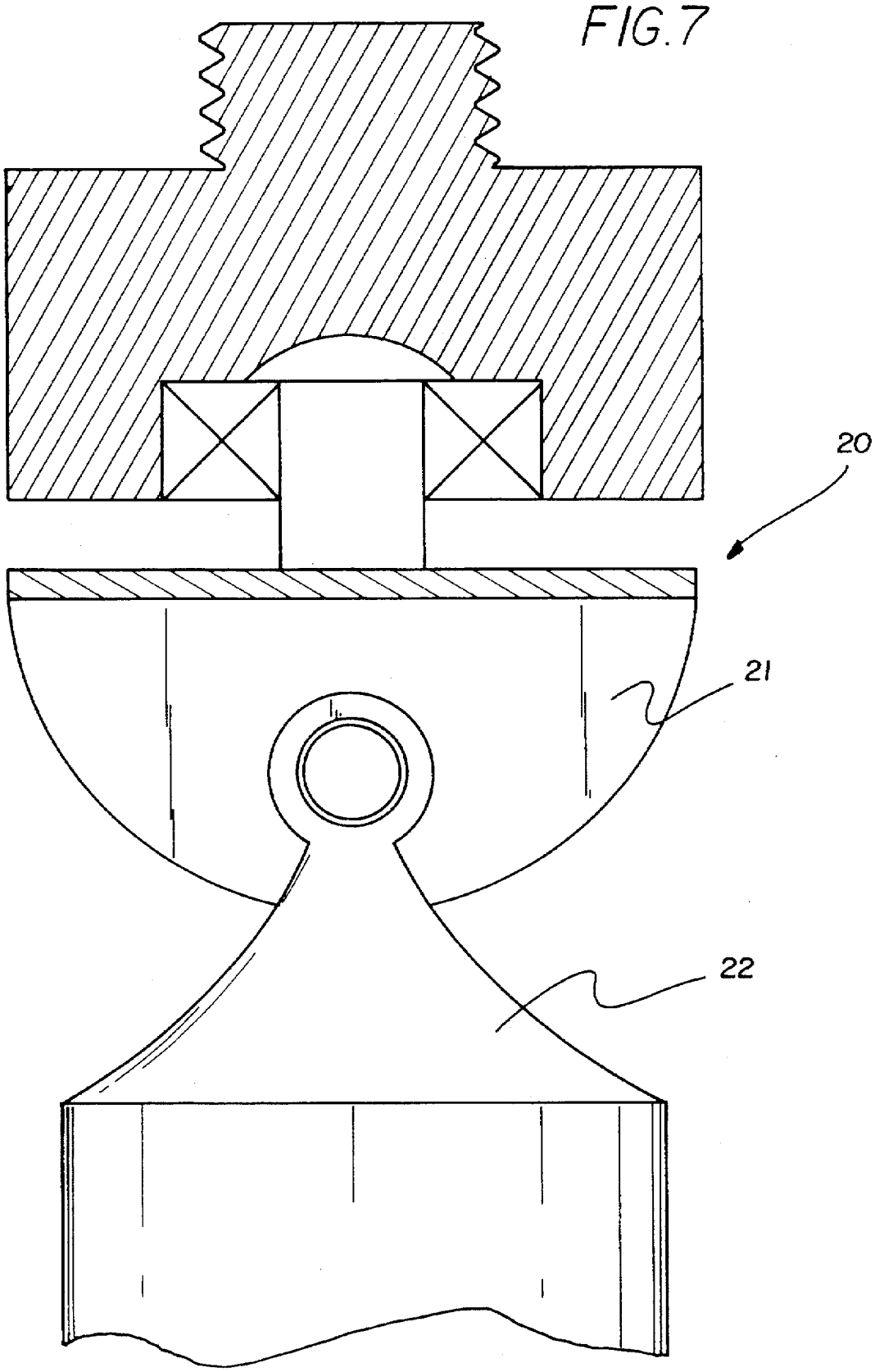
FIG. 7 is a schematic sectional view of a hinge member of the present invention.

With reference now to the drawings, and in particular to FIGS. 1 through 7 thereof, a new jump rope simulator embodying the principles and concepts of the present invention and generally designated by the reference numeral 10 will be described.

As best illustrated in FIGS. 1 through 7, the jump rope simulator 10 generally comprises a pair of hand-held units 11,12. Each unit 11,12 includes a handle 13 and a flexible cord 17. The handle 13 has opposite first and second ends 14,15. One of the ends 18 of the flexible cord 17 is coupled to the first end 14 of the handle 13 such that the flexible cord 17 may be twirled about a twirling axis extending from the handle 13.

In use, the hand-held units 11,12 are designed to be held in the hands of a user in the same fashion as holding the handles of a jump rope. The user then jumps up and down and twirls their hands so that the units are twirled in a similar fashion as a traditional jump rope. In closer detail, the handle 13 of each unit has opposite first and second ends 14,15. Ideally, the handle 13 is contoured to comfortably fit a hand of a user. In this ideal embodiment, the handle 13 preferably has a resiliently compressible outer layer 16 therearound. Ideally, the outer layer 16 of the handle 13 comprises a resiliently compressible foamed rubber.

The elongate flexible cord 17 has a pair of opposite ends 18,19. One of the ends 18 of the flexible cord 17 is coupled to the first end 14 of the handle 13 such that the flexible cord 17 may be twirled by a user holding the handle 13 about a twirling axis extending from the handle 13. Preferably, a hinge member 20 pivotally couples the flexible cord 17 to the first end 14 of the handle 13. The hinge member 20 has a first portion 21 and a second portion 22. The first and second portions 21,22 of the hinge member 20 are pivotally coupled together. The first portion 21 of the hinge member 20 is detachably attached to the first end 14 of the handle 13. Ideally, the first portion 21 of the hinge member 20 is threadably inserted into the first end 14 of the handle 13 to detachably attach the first portion 21 of the hinge member 20 to the first end 14 of the handle 13. The second portion 22 of the hinge member 20 is coupled to the one end 18 of the flexible cord 17.

Preferably, the flexible cord 17 has a distribution of weight is biased toward the free end 19 of the flexible cord 17 for helping provide a smooth twirling motion by the flexible cord 17 about the twirling axis. In one preferred embodiment, the cord 17 is simply a length of flexible rope with a weight at its free end 19 for biasing its weight distribution towards that end 19. In another preferred embodiment, the flexible cord 17 comprises a flexible tubular casing 23 having a lumen. Ideally, a cloth material exterior layer 24 is provided on the casing for providing padding. In this embodiment, the flexible cord 17 has ballast 25 provided in the lumen of the tubular casing 23. Ideally, the ballast 25 substantially fills the lumen of the tubular casing 23. In this embodiment, the diameter of the flexible cord 17 progressively tapers from the attached end 18 towards the free end 19 of the flexible cord 17 so that the weight of the flexible cord is biased towards the free end 19.

Preferably, the handle 13 of one of the units 11 has a jump counting device therein for counting the number of jumps performed by a user twirling the unit. The jump counting device has a visual display 27 for numerically displaying the number of jumps counted by the jump counting device. Preferably, the visual display 27 of the jump counting device is mounted on the handle 13 of the one unit and positioned towards the second end 15 of the handle 13 of the unit 11. The jump counting device preferably has a reset actuator 28 mounted on the second end 15 of the handle 13 of the one unit. This reset actuator 28 resets the number of jumps counted by the jump counting device to zero when the reset actuator is engaged (that is, pressed) by a user.

Also preferably, the handle 13 of the other unit 12 has a calorie counting device therein for calculating the number of calories consumed (that is, burned) by a user twirling the unit. The calorie counting device has a visual display 29 for numerically displaying the number of consumed calories calculated by the calorie counting device. The visual display 29 of the calorie counting device is mounted on the handle 13 of the unit 12 preferably positioned towards the second end 15 of the handle 13 of this unit 12. Like the jump counting device, the calorie counting device also preferably has a reset actuator 30 mounted on the second end 15 of the handle 13 of the other unit. This reset actuator 30 permits a user to reset the number of consumed calories calculated by the calorie counting device to zero when the reset actuator is engaged by a user.

A battery power source 26 for powering the associated counting device is disposed in a space in the interior of the handle 13 with a removable cap 31 provided on the first end of the handle closing the space. The battery 26 of each unit is electrically connected to the associated counting device of the unit. The battery 26 is removable from the space in the interior of the handle 13 for convenient replacement when the hinge member 20 is detached from the first end 14 of the handle 13.

In an ideal illustrative embodiment, the handle 13 has a diameter of about 1 inch and each unit has a length defined between the second end 15 of the handle 13 and the weighted end 19 of the flexible cord 17 of about 2½ feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jump rope simulator, comprising:

a pair of hand-held units;

each unit comprising:

a handle having opposite first and second ends; an elongate flexible cord having a pair of opposite ends; and one of said ends of said flexible cord being coupled to said first end of said handle such that said flexible cord may be twirled about a twirling axis extending from said handles;

wherein said flexible cord is a length of flexible rope having a weight at a free end thereof for biasing a weight distribution thereof towards said free end;

said flexible cord having a diameter, said diameter of said flexible cord progressively tapering from said free end of said flexible cord towards said handle;

said flexible cord comprising a flexible tubular casing having a lumen and a cloth material exterior layer for providing padding.

2. The jump rope simulator of claim 1, wherein said handle has a resiliently compressible outer layer therearound.

3. The jump rope simulator of claim 2, wherein said outer layer of said handle comprises a resiliently compressible foamed rubber.

4. The jump rope simulator of claim 1, wherein a hinge member pivotally couples said flexible cord to said first end of said handle, said hinge member having a first portion and a second portion, said first and second portions of said hinge member being pivotally coupled together, said first portion of said hinge member being attached to said first end of said handle, said second portion of said hinge member being coupled to said one end of said flexible cord.

5. The jump rope simulator of claim 1, wherein said handle of one of said units has a jump counting device for counting the number of jumps performed by a user, said jump counting device having a visual display for displaying the number of jumps counted by said jump counting device, said visual display of said jump counting device being mounted on said handle of said one unit, said visual display of said jump counting device being positioned towards said second end of said handle of said one unit.

6. The jump rope simulator of claim 5, wherein said jump counting device having a reset actuator being mounted on said second end of said handle of said one unit.

7. The jump rope simulator of claim 1, wherein said handle of one of said units has a calorie counting device for calculating the number of calories consumed by a user, said calorie counting device having a visual display for displaying the number of consumed calories calculated by said calorie counting device, said visual display of said calorie counting device being mounted on said handle of said one unit.

8. The jump rope simulator of claim 7, wherein said visual display of said calorie counting device is positioned towards said second end of said handle of said one unit.

9. The jump rope simulator of claim 7, wherein said calorie counting device has a reset actuator being mounted on said second end of said handle of said one unit.

10. A jump rope simulator, comprising:

a pair of hand-held units;

each unit comprising:

a handle having opposite first and second ends, wherein said handle is contoured to fit a hand of a user;

said handle having a resiliently compressible outer layer therearound, wherein said outer layer of said handle comprises a resiliently compressible foamed rubber;

an elongate flexible cord having a pair of opposite ends;

one of said ends of said flexible cord being coupled to said first end of said handle such that said flexible cord may be twirled about a twirling axis extending from said handle;

wherein a hinge member pivotally couples said flexible cord to said first end of said handle;

said hinge member having a first portion and a second portion, said first and second portions of said hinge member being pivotally coupled together;

said first portion of said hinge member having a substantially disk-shaped configuration and being detachably attached to said first end of said handle, wherein said first portion of said hinge member is threadably inserted into said first end of said handle to detachably attach said first portion of said hinge member to said first end of said handle;

said second portion of said hinge member including a clevis with a base rotatable coupled to a center of said first portion of said hinge member for rotating about a central axis of said first portion of said hinge member and further including a fork for being rotatable coupled to said one end of said flexible cord about an axis perpendicular with respect to the central axis of said first portion of said hinge member; and said flexible cord having a distribution of weight being biased toward another of said ends of said flexible cord for helping provide a smooth twirling motion by said flexible cord about the twirling axis;

wherein said flexible cord is a length of flexible rope having a weight at a free end thereof for biasing a weight distribution thereof towards said free end;

said flexible cord having a diameter, said diameter of said flexible cord progressively tapering from said free end of said flexible cord towards said handle;

said flexible cord comprising a flexible tubular casing having a lumen and a cloth material exterior layer for providing padding, said flexible cord having a ballast being provided in said lumen of said tubular casing, wherein said ballast substantially fills said lumen of said tubular casing;

a battery power source being provided in a space in said interior of said handle, said first portion of said hinge member being threadedly coupled to a cap which is in turn threadedly coupled to said handle for closing said space when said cap is attached to said first end of said handle, said battery power source being removable from said space in said interior of said handle when said cap is detached from said first end of said handle;

said handle of one of said units having a jump counting device therein for counting the number of jumps performed by a user twirling said unit, said jump counting device having a visual display for numerically displaying the number of jumps counted by said jump counting device, said visual display of said jump counting device being mounted on said handle of said one unit, said visual display of said jump counting device being positioned towards said second end of said handle of said one unit;

said jump counting device having a reset actuator being mounted on said second end of said handle of said one unit, said reset actuator positioned on the second end of said handle of said one unit and extending axially therefrom for resetting the number of jumps counted by said jump counting device to zero when said reset actuator is pressed by a user;

said handle of the other of said units having a calorie counting device therein for calculating the number of calories consumed by a user twirling said unit, said calorie counting device having a visual display for numerically displaying the number of consumed calories calculated by said calorie counting device, said visual display of said calorie counting device being mounted on said handle of said other unit, said visual display of said calorie counting device being positioned towards said second end of said handle of said other unit; and said calorie counting device having a reset actuator being mounted on said second end of said handle of said other unit, said reset actuator of said calorie counting device being positioned on the second end of said handle of said one unit and extending axially therefrom for resetting the number of consumed calories calculated by said calorie counting device to zero when said reset actuator is pressed by a user;

wherein said handle has a diameter of about 1 inch;

wherein each unit has a length defined between said second end of said handle and said free end of said flexible cord, said length being 2½ feet.

* * * * *